US008466619B2

(12) United States Patent
Lee et al.

(10) Patent No.: US 8,466,619 B2
(45) **Date of Patent: *Jun. 18, 2013**

(54) ILLUMINATION APPARATUS AND DRIVING METHOD THEREOF

(75) Inventors: Young Hwan Lee, Seoul (KR); Kwan Soo Jang, Seoul (KR); Chung Hyun Cho, Goyang-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 495 days.

This patent is subject to a terminal disclaimer.

(21) Appl. No.: 12/615,155

(22) Filed: Nov. 9, 2009

(65) Prior Publication Data

US 2010/0117559 A1 May 13, 2010

Related U.S. Application Data

(60) Provisional application No. 61/113,539, filed on Nov. 11, 2008, provisional application No. 61/113,536, filed on Nov. 11, 2008.

(30) Foreign Application Priority Data

Nov. 11, 2008 (KR) ..... 10-2008-0111896
Nov. 11, 2008 (KR) ..... 10-2008-0111897

(51) Int. Cl.
*H01J 7/44* (2006.01)

(52) U.S. Cl.
USPC ..... 315/51; 362/249.03; 362/249.07

(58) Field of Classification Search
USPC ..... 315/51, 72, 200 R, 208 R, 246, 291, 315/294, 287, 207; 439/236, 620.01, 620.02; 362/227, 249.01, 249.02, 249.05, 249.06, 362/249.14, 249.03, 249.07
See application file for complete search history.

(56) References Cited

U.S. PATENT DOCUMENTS

| | | | | |
|---|---|---|---|---|
| 5,442,258 | A * | 8/1995 | Shibata | 315/129 |
| 5,759,054 | A * | 6/1998 | Spadafore | 439/236 |
| 5,924,784 | A * | 7/1999 | Chliwnyj et al. | 362/234 |
| 7,932,679 | B2 * | 4/2011 | Ball | 315/247 |
| 8,035,307 | B2 * | 10/2011 | Chew | 315/200 R |
| 2004/0066142 | A1 * | 4/2004 | Stimac et al. | 315/50 |

* cited by examiner

*Primary Examiner* — Thuy Vinh Tran
(74) *Attorney, Agent, or Firm* — The Law Offices of Andrew D. Fortney; Andrew D. Fortney

(57) ABSTRACT

An illumination apparatus includes an adapter that converts power into driving power; a light emitting device illumination part that is detachably and electrically connected to the adapter to emit light according to the driving power from the adapter; and a driving unit that controls an illumination direction of the light emitting device.

20 Claims, 7 Drawing Sheets

ILLUMINATION APPARATUS AND DRIVING METHOD THEREOF

The present application claims priority to Korean Patent Application Nos. 10-2008-0111896 (filed on Nov. 11, 2008) and 10-2008-0111897 (filed on Nov. 11, 2008) under 35 U.S.C. 119(a)-(d), and to U.S. Provisional Application Nos. 61/113,539 (filed on Nov. 11, 2008) and 61/113,536 (filed on Nov. 11, 2008) under 35 U.S.C. 119(e), which are hereby incorporated by reference in their entireties.

BACKGROUND

Description of the Related Art

Embodiments of the invention relate to an illumination apparatus and a driving method thereof.

At the present time, a fluorescent lamp or an incandescent lamp has been widely used as an illumination apparatus. In particular, the fluorescent lamp has low power consumption and high brightness so that it has been widely used at office or at home.

Meanwhile, an illumination apparatus that replaces the fluorescent lamp or the incandescent lamp has been recently developed and, representatively, an illumination apparatus using a light emitting diode (LED) has been introduced.

However, in the case of the illumination apparatus using the LED, it is driven with different voltage from the fluorescent lamp or the incandescent lamp, causing a problem that all of power supply apparatus including conventionally installed sockets should be replaced when using the illumination apparatus using the LED.

SUMMARY OF THE INVENTION

Embodiments of the invention provide an illumination apparatus with a new structure using a LED or an OLED, and a driving method thereof.

Various embodiments provide an illumination apparatus using the LED or the OLED that can be used without replacing a power supply apparatus installed for a conventional fluorescent lamp, an incandescent lamp, a halogen lamp, etc.

Various embodiments provide an illumination apparatus that can compatibly use various light emitting device illumination units by detachably installing an adapter and a light emitting device illumination unit.

Various embodiments provide an illumination apparatus that can control an illumination direction of the apparatus in a desired direction.

Various embodiments provide an illumination apparatus capable of increasing a length between light emitting device illumination parts or changing illumination directions of the light emitting device illumination part, if necessary, by installing an elastic connection part between adjacent light emitting device illumination part sections.

An illumination apparatus according to the embodiments includes an adapter that converts alternating power into driving power; a light emitting device illumination part that is configured to be detachably and electrically connected to the adapter and configured to emit light according to the driving power from the adapter; and a driving unit that is configured to control an illumination direction of the light emitting devices in the light emitting device illumination part.

An illumination apparatus according to the embodiments includes an adapter that converts alternating power into driving power; a light emitting device illumination part including a plurality of light emitting device modules that is configured to be detachably and electrically connected to the adapter and to emit light according to the driving power from the adapter; and a connection part between adjacent light emitting device modules.

A method of driving an illumination apparatus according to various embodiments includes converting alternating power into driving power in an adapter; emitting light from a light emitting device illumination part according to the driving power, the light emitting device illumination part being detachably and electrically connected to the adapter; and controlling an illumination direction of the light emitting device illumination part in a driving unit that is connected to the adapter.

DETAILED DESCRIPTION OF THE EMBODIMENTS

Figure 1:
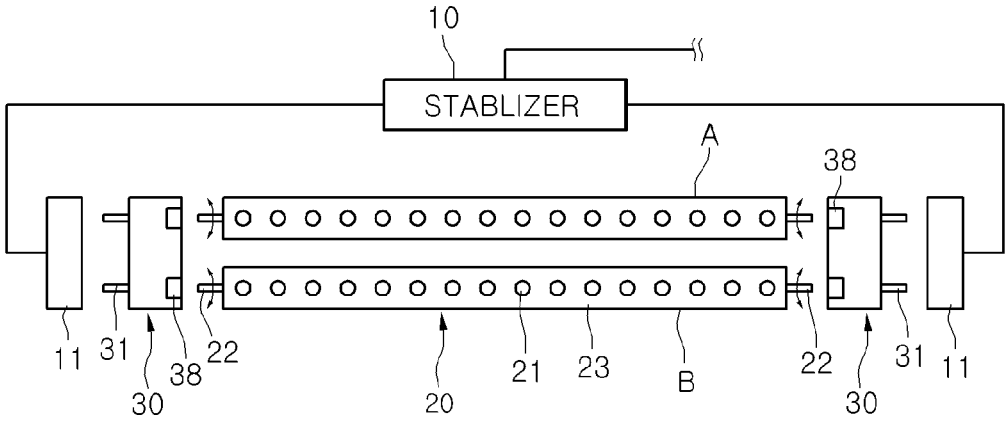
FIG. 1 is a diagram explaining an illumination apparatus according to a first embodiment.

In the drawings, the thickness or size of each layer is exaggerated, omitted or schematically illustrated for the convenience and clarity of explanation. Also, the size of each constituent does not completely reflect its actual size.

Hereinafter, an illumination apparatus according to embodiments will be described with reference to the accompanying drawings.

Figure 2:
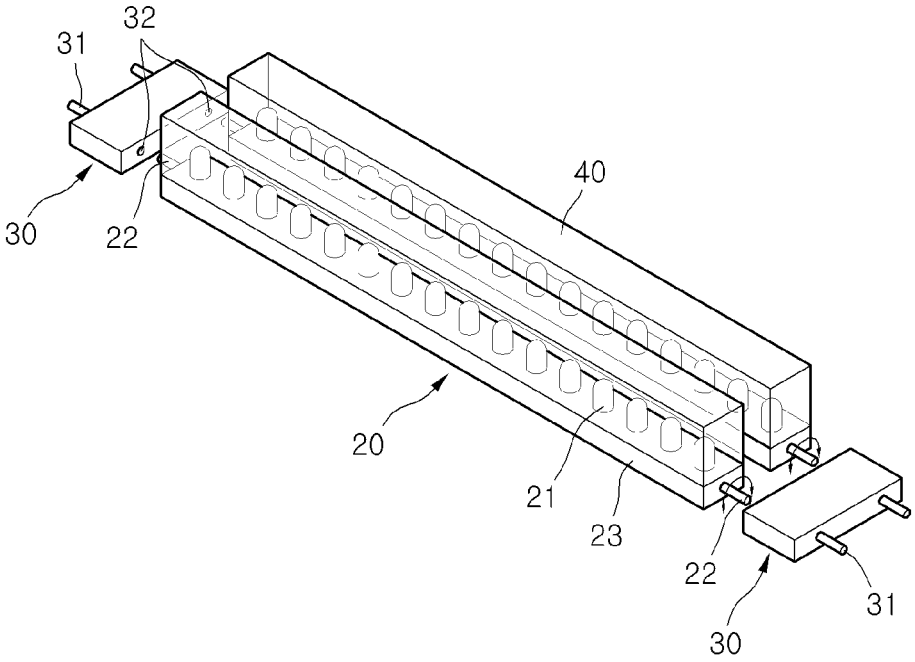
FIG. 2 is a perspective view of the illumination apparatus according to the first embodiment.

FIG. 1 is a diagram for explaining an illumination apparatus according to a first embodiment, and FIG. 2 is a perspective view of the illumination apparatus according to the first embodiment.

First, referring to FIGS. 1 and 2, the illumination apparatus according to the first embodiment includes a power terminal 22 formed at both ends of a substrate 23, a light emitting device illumination part 20 having a plurality of light emitting devices 21 on the upper surface of the substrate 23, and an adapter coupled at opposite sides of the light emitting device illumination part 20. Moreover, a cover 40 that protects the light emitting devices 21 may further be installed on the substrate 23.

The light emitting device illumination part 20 may be configured of a plurality of modules in a plurality of panel shapes, for example, module A, module B, etc., but is not limited thereto.

In the light emitting device illumination part 20, the plurality of light emitting devices 21 are arranged on the substrate 23. The light emitting devices 21 may be LED or OLED.

The substrate 23 may be a printed circuit board (PCB) on which a circuit pattern for providing power to the light emitting devices 21 is formed. Also, the substrate 23 may be a substrate that a wiring for providing power to the light emitting devices 21 is installed on a plastic instrument.

Moreover, a reflective coating layer (not shown) may be formed on the surface of the substrate 23, making it possible to increase efficiency of light emitted from the light emitting devices 21 by coating it with silver (Ag) or aluminum (Al).

The plurality of light emitting devices 21 may include LED or OLED that light-emit red, blue, and green, and may also include LED or OLED that light-emit white.

The cover 40 may be formed of transparent plastic material, and may also be formed of plastic with various colors such as red, green, blue, etc., as needed. Also, the cover 40 may be formed of translucent material and in this case, it may also provide an illumination with a soft atmosphere.

The power terminal 22 that can be electrically connected to the adapter 30 are installed at opposite ends of the substrate 23, thereby supplying power to the light emitting devices 21 from the outside.

One side of the adapter 30 is provided with a connector 31 that is inserted into the socket 11 for installing a conventional fluorescent lamp, and the other side thereof is provided with a power terminal groove 32 into which the power terminal 22 of the light emitting device illumination part 20 are inserted.

The light emitting device illumination part 20 is coupled to the adapter 30 so that the illumination apparatus according to the first embodiment can be installed at the socket 11 where a conventional fluorescent lamp is installed. Therefore, although a power supply apparatus including the socket 11 where the conventional fluorescent lamp is installed is not replaced, an illumination apparatus using LED or OLED can be used.

In particular, since the light emitting device illumination part 20 and the adapter 30 are detachably installed, when defects are generated on the light emitting device illumination part 20 or the adapter 30, only the light emitting device illumination part 20 or the adapter 30 where the defects are generated can be replaced, having low maintenance costs.

Moreover, since the light emitting device illumination part 20 and the adapter 30 are detachably installed, illuminations with various atmospheres can be provided by replacing only the light emitting device illumination part 20.

In addition, the first embodiment may form the light emitting device illumination part 20 in the plurality of panel shapes and may further include a driving unit 38 that can rotatably drive the light emitting device illumination part 20. The driving unit 38 may be formed in the adapter 30 and can generate power by a motor, etc., but is not limited thereto. Therefore, the illumination apparatus according to the first embodiment can face the light emitting device illumination part 20 to a desired direction, making it possible to control the illumination direction.

Figure 3:
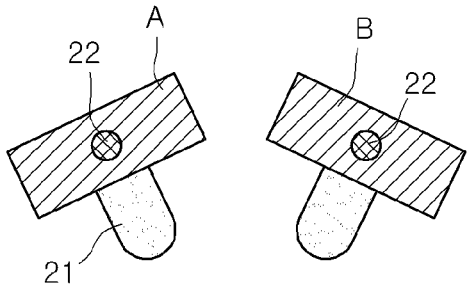
FIG. 3 is a diagram showing an operation example of the illumination apparatus according to the first embodiment.

FIG. 3 is a diagram showing an operation example of the illumination apparatus according to the first embodiment. FIG. 3 shows an example that the illumination can be concentrated by facing each of the first module and the second module of the light emitting device illumination part 20 to the same direction. Unlike this, the illumination can be concentrated on a wider area by facing the first module and the second module to different directions.

Figure 4:
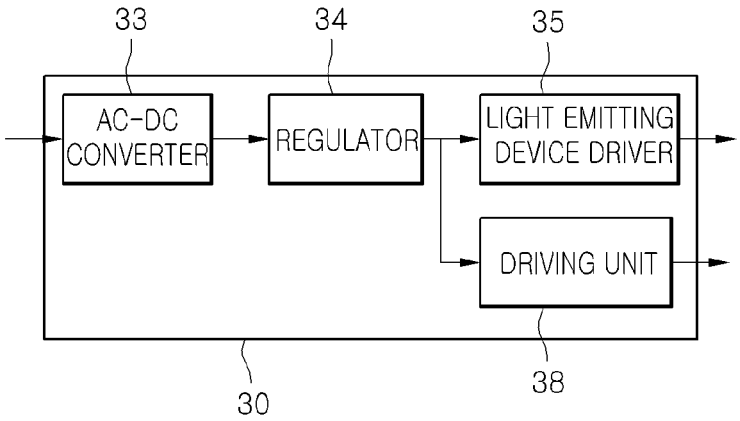
FIG. 4 is a diagram explaining an adapter in the illumination apparatus according to the first embodiment.

Referring to FIG. 4, the adapter 30 includes an AC-DC converter 33, a regulator 34, a light emitting device driver 35, and a driving unit 38. The AC-DC converter 33 converts AC power supplied through the socket 11 into DC power, the regulator 34 allows the DC power output from the AC-DC converter 33 to be output as constant DC voltage, and the light emitting device driver 35 outputs the DC voltage supplied from the regulator 34 as driving pulse proper in driving the plurality of light emitting devices 121. For example, as shown in FIG. 4, the adapter 30 includes a bridge rectifier 33*a* and a smoothing circuit 34*a* to allow constant DC voltage to be output. The driving unit 38 may be formed in the adapter 30 and can generate power by a motor, etc., but is not limited thereto.

Therefore, the light emitting device illumination part 20 can also be used in the power supply apparatus for the conventional fluorescent lamp to which the AC power is supplied by the adapter 30 that includes the AC-DC converter 33, the regulator 34, the light emitting device driver 35, and the driving unit 38.

In other words, as shown in FIG. 1, the power supply apparatus for the fluorescent lamp includes a stabilizer 10 that converts commercial power into high frequency current of 20-50 kHz and two sockets 11 connected to the stabilizer 10, wherein only high frequency AC current is provided through the sockets 11 so that the light emitting device illumination part 20 cannot be installed directly on the conventional power supply apparatus.

However, the illumination apparatus according to the first embodiment installs the adapter 30, making it possible to use the light emitting device illumination part 20, while using the conventional power supply apparatus as it is.

Moreover, since the adapter 30 and the light emitting device illumination part 20 are detachable, the illumination apparatus can be used to be connected to only the light emitting device illumination part 20 by separating the adapter 30 from the light emitting device illumination part 20 where the power supply apparatus for the light emitting device illumination part 20 is installed.

Figure 6:
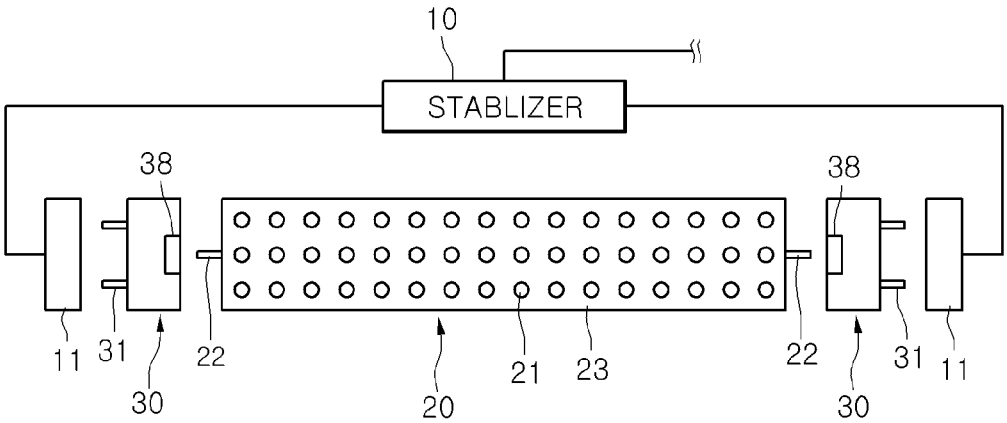
FIG. 6 is a diagram for explaining another embodiment of an illumination apparatus according to the first embodiment.

FIG. 6 is a diagram for explaining another embodiment of the illumination apparatus according to the first embodiment and shown an example that the light emitting device illumination part 20 is formed in a single module. Thereby, the illumination apparatus can be effectively used in an environment where providing the illumination direction to perform the concentrating illumination is effective.

Figure 7:
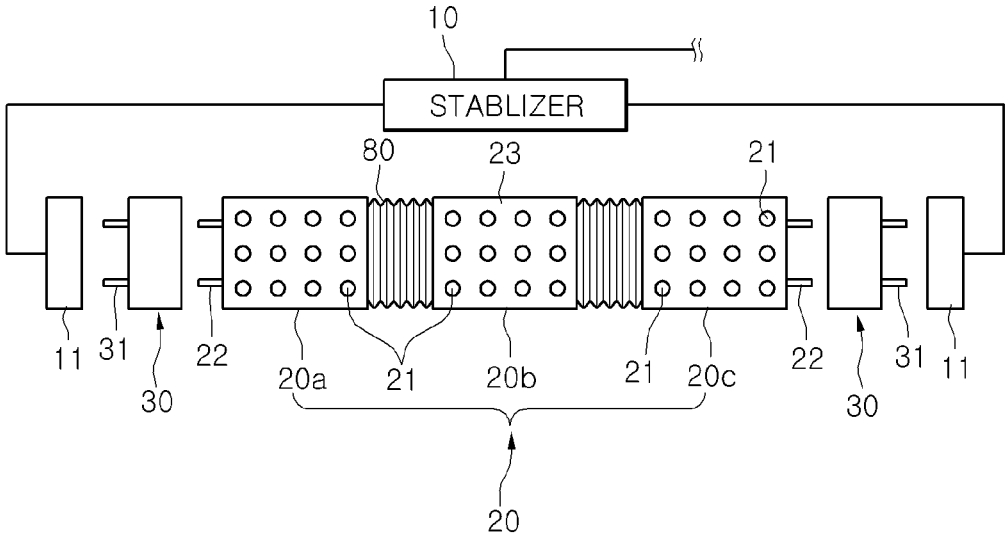
FIG. 7 is a diagram for explaining an illumination apparatus according to a second embodiment.
Figure 8:
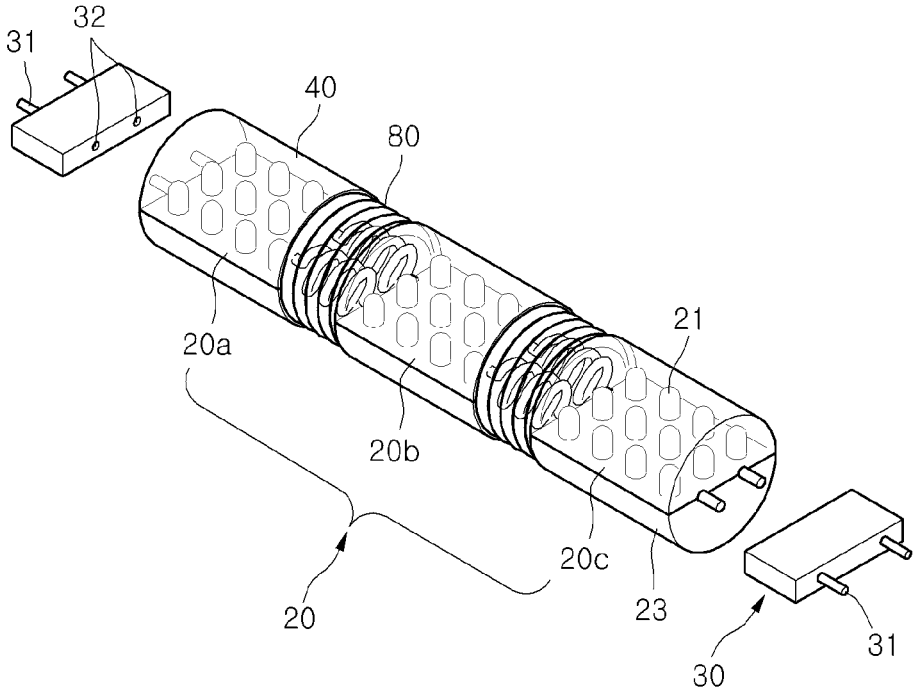
FIG. 8 is a perspective view of the illumination apparatus according to the second embodiment.
Figure 9:
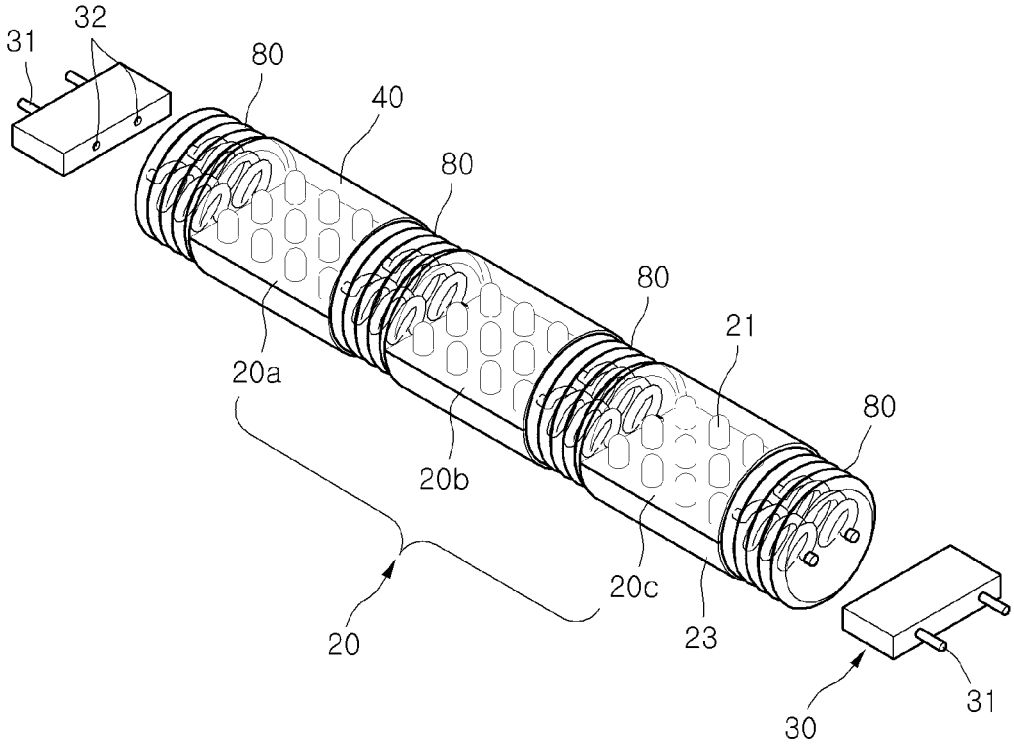
FIG. 9 is a perspective view for explaining another embodiment of the illumination apparatus according to the second embodiment.
Figure 10:
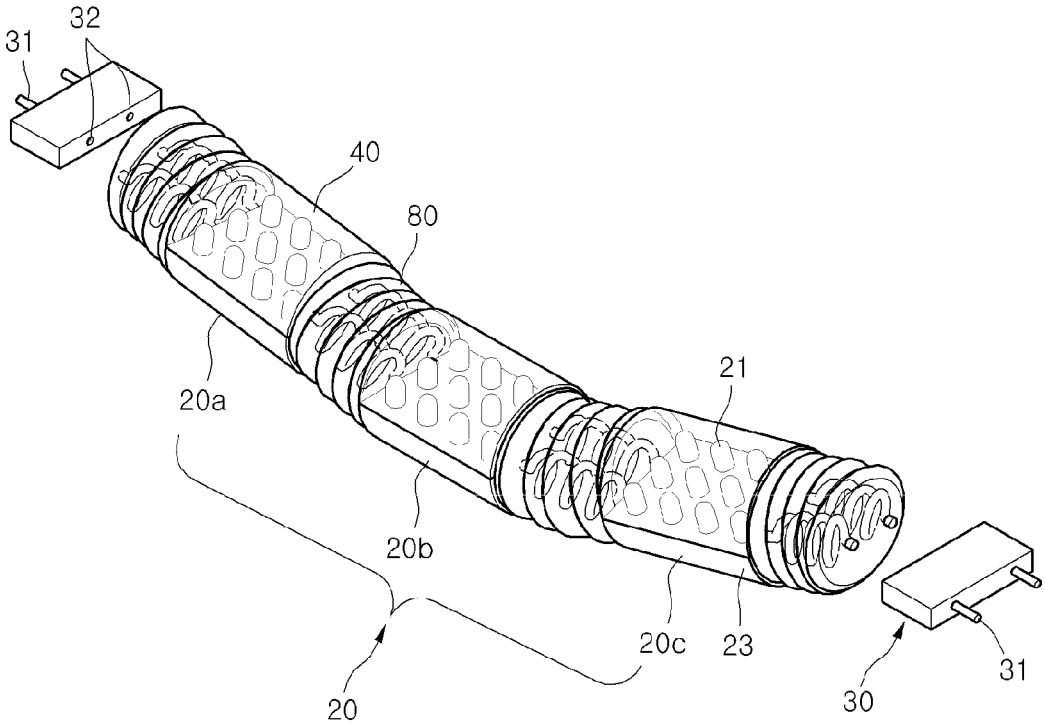
FIG. 10 is a diagram showing a use of another embodiment of the illumination apparatus according to the second embodiment.

FIG. 7 is a diagram for explaining an illumination apparatus according to a second embodiment, FIG. 8 is a perspective view of the illumination apparatus according to the second embodiment, FIG. 9 is a perspective view for explaining another embodiment of the illumination apparatus according to the second embodiment, and FIG. 10 is a diagram showing a use of the illumination apparatus according to the second embodiment.

Referring first to FIGS. 7 and 8, the illumination apparatus according to the second embodiment includes the light emitting device illumination part 20. The light emitting device illumination part 20 includes a first light emitting device module 20*a*, a second light emitting device module 20*b*, and a third light emitting device module 20*c* and includes a connection part 80 between the plurality of light emitting device modules that are illustrated as the first light emitting device module 20*a*, the second light emitting device module 20*b*, and the third light emitting device module 20*c*.

Each of the first light emitting device module 20*a*, second light emitting device module 20*b*, and third light emitting device module 20*c* includes the substrate 23 and the light emitting device 21 that is installed on the substrate 23 and the power terminal 22 is formed at opposite ends of the substrate 23 that is connected to the adapter 30. The light emitting device 21 may be an LED or an OLED.

Further, a cover 40 for protecting the light emitting device 21 may be further installed on the substrate 23.

The substrate 23 may be a printed circuit board (PCB) on which a circuit pattern for providing power to the light emitting device 21 is formed. In addition, the substrate 23 may be a substrate that a wiring for providing power to the light emitting devices 21 is installed on a plastic instrument.

In addition, a reflective coating layer (not shown) may be formed on the surface of the substrate 23, making it possible to increase efficiency of light emitted from the light emitting devices 21 by coating it with silver (Ag) or aluminum (Al).

The plurality of light emitting devices 21 may include an LED or an OLED that can light-emit red, blue, and green and an LED or an OLED that can light-emit white.

The cover 40 may be made of a transparent plastic material and may be made of plastic having various colors such as red, green, blue, etc., if necessary. In addition, the cover may be formed of a translucent material and in this case, it may also provide an illumination with a soft atmosphere.

The power terminal 22 that can be electrically connected to the adapter 30 are installed at opposite ends of the substrate 23, thereby supplying power to the light emitting devices 21 from the outside.

One side of the adapter 30 is provided with a connector 31 that is inserted into the socket 11 for installing a conventional fluorescent lamp, and the other side thereof is provided with a power terminal groove 32 into which the power terminal 22 of the light emitting device illumination part 20 are inserted.

The illumination apparatus according to the second embodiment may be installed in the socket in which the existing fluorescent lamp is installed by connecting the light emitting device illumination unit 20 and the adapter 30. Therefore, embodiments can use the illumination apparatus using the LED or the OLED without replacing the power supply apparatus including the socket 11 in which the existing fluorescent lamp is installed.

In particular, since the light emitting device illumination unit 20 and the adapter 30 are detachably installed, when defects are generated on the light emitting device illumination unit 20 or the adapter 30, only the light emitting device illumination unit 20 or the adapter 30 where the defects are generated can be replaced, having low maintenance costs.

Moreover, since the light emitting device illumination unit 20 and the adapter 30 are detachably installed, illuminations with various atmospheres can be provided by replacing only the light emitting device illumination unit 20.

Further, as shown in FIG. 9, another embodiment of the illumination apparatus according to the second embodiment further includes a connection part 80 between the light emitting device modules 20*a* and 20*c* and the adapter 30 at opposite sides of the adapter 30, making it possible to further increase the length of the illumination apparatus.

As shown in FIG. 10, the second embodiment installs the elastic connection part 80 between the plurality of light emitting device modules 20*a*, 20*b*, and 20*c*, making it possible to provide the illumination apparatus that can increase the length of the illumination apparatus if necessary.

Figure 11:
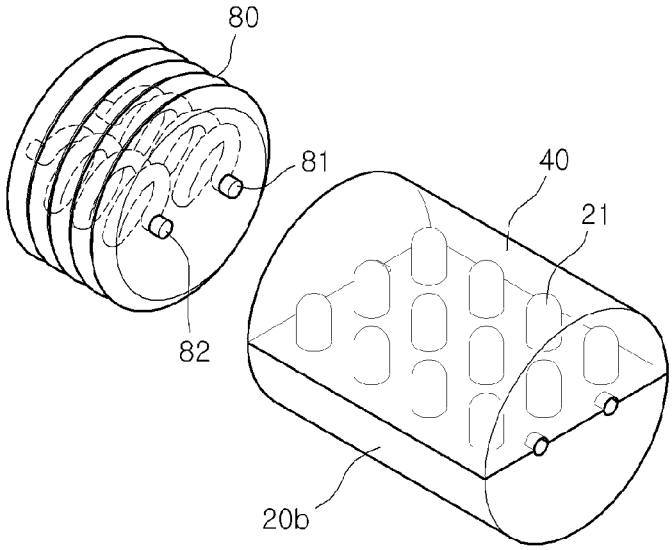
FIG. 11 is a partially enlarged view of a connection part and a light emitting module in the illumination apparatus according to the second embodiment.
Figure 12:
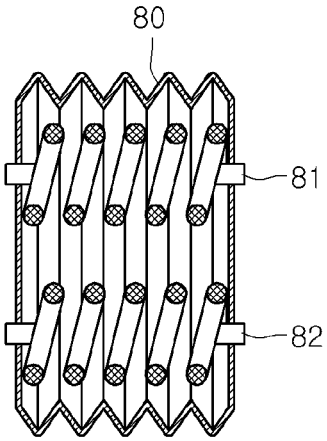
FIG. 12 is a cross-sectional view of the connection part in the illumination apparatus according to the second embodiment.

FIG. 11 is a partially enlarged view of the connection part and the light emitting module in the illumination apparatus according to the second embodiment, and FIG. 12 is a cross-sectional view of the connection part in the illumination apparatus according to the second embodiment.

As shown in FIGS. 11 and 12, the connection part 80 may include conductors 81 and 82 that connect the plurality of light emitting modules 20*a*, 20*b*, and 20*c*. For example, the conductors 81 and 82 may be an elastic conductor in a spring shape that connects the plurality of light emitting devices 20*a*, 20*b*, and 20*c*, but are not limited thereto. In the second embodiment, the illumination apparatus can be used by extending the connection part 80 according to the environment where the illumination apparatus is used. At this time, when the conductors 81 and 82 of the connection part 80 are made of a metal with elasticity and conductivity, for example, a material such as iron (Fe), the illumination apparatus is extended and can be then recovered to an original shape.

On the other hand, when the conductors 81 and 82 are made of a material without elasticity but with conductivity, for example, copper (Cu), etc., the illumination apparatus is extended in a required shape and then, the illumination apparatus can be used in the extended state, without the influence of the external environment.

Further, when the conductors 81 and 82 of the connection part 80 are made of a shape memory alloy, etc., the illumination apparatus is used in the extended state if necessary and when the connection part 80 is then applied with heat, etc., it is recovered to an original state, making it possible to use the illumination apparatus in an original state that is not extended.

In the second embodiment, the connection part 80 may further include a nonconductor that surrounds the conductors 81 and 82. For example, the connection part 80 includes an opaque nonconductor such as rubber, etc., to surround the conductors 81 and 82, but is not limited thereto.

The second embodiment installs the elastic connection part 80 between the plurality of light emitting device modules 20*a*, 20*b*, and 20*c*, making it possible to increase the length of the illumination apparatus if necessary.

Figure 13:
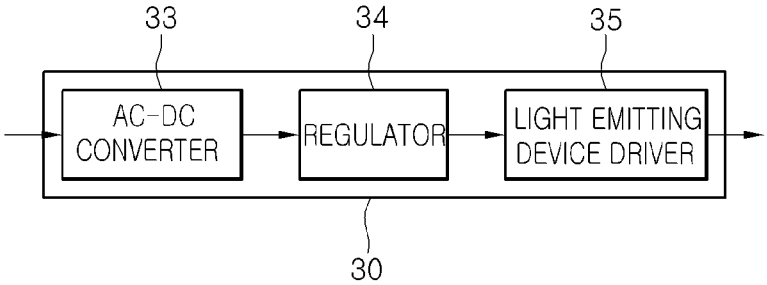
FIG. 13 is a diagram for explaining in an adapter in the illumination apparatus according to the second embodiment.

Referring to FIG. 13, the adapter 30 includes the AC-DC converter 33, the regulator 34, and the light emitting device driver 35.

Figure 5:
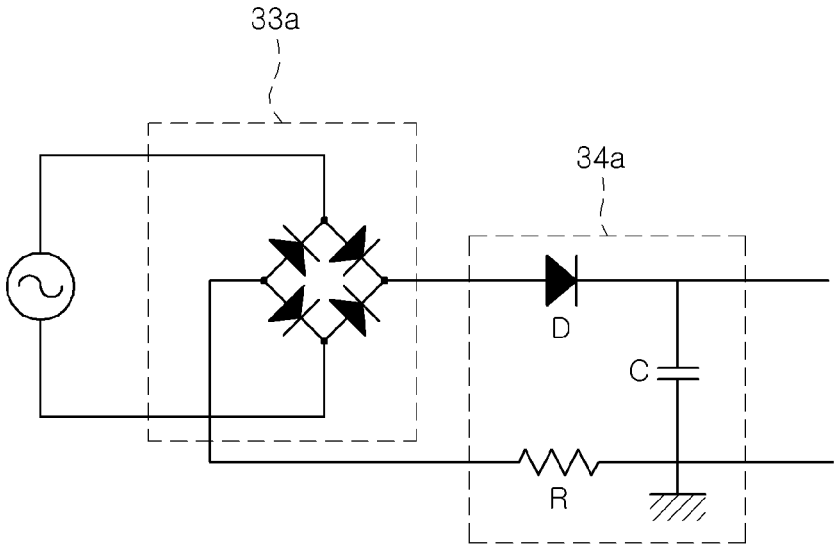
FIG. 5 is a diagram showing the AC-DC converter of the adapter in the illumination apparatus according to the first embodiment.

The AC-DC converter 33 converts AC power supplied through the socket 11 into DC power, the regulator 34 allows the DC power output from the AC-DC converter 33 to be output as constant DC voltage, and the light emitting device driver 35 outputs the DC voltage supplied from the regulator 34 as one or more driving pulses, sufficient or proper to drive the plurality of light emitting devices 121. For example, as shown in FIG. 5, the adapter 30 includes a bridge rectifier 33*a* and a smoothing circuit 34*a* to allow constant DC voltage to be output.

Therefore, the light emitting device illumination part 20 can also be used in the power supply apparatus for the conventional fluorescent lamp to which the AC power is supplied by the adapter 30 that includes the AC-DC converter 33, the regulator 34, and the light emitting device driver 35.

Embodiments of the invention can provide the illumination apparatus having a new structure using the LED or the OLED.

Various embodiments can provide the illumination apparatus using the LED or the OLED that can be used, without replacing the power supply apparatus installed for the existing fluorescent lamp, incandescent lamp, a halogen lamp, etc.

Various embodiments can provide the illumination apparatus that can compatibly use various light emitting device illumination units by detachably installing the adapter and a light emitting device illumination unit.

Various embodiments can provide an illumination apparatus that can control an illumination direction in a desired direction.

Various embodiments can provide an illumination apparatus capable of increasing a length between light emitting device illumination parts or changing illumination directions of the light emitting device illumination part by installing an elastic connection part (e.g., between adjacent light emitting device illumination part sections).

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is within the purview of one skilled in the art to effect such feature, structure, or characteristic in connection with other embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An illumination apparatus, comprising:

an adapter that converts alternating power into driving power;

a light emitting device illumination part configured to be detachably and electrically connected to the adapter and configured to emit light according to the driving power from the adapter; and a driving unit that rotatably drives the light emitting device illumination part to control an illumination direction of the light emitting device illumination part.

2. The illumination apparatus according to claim 1, wherein the driving unit is in the adapter.

3. The illumination apparatus according to claim 1, wherein the light emitting device illumination part has a plurality of panels.

4. The illumination apparatus according to claim 1, wherein the adapter includes:

an AC-DC converter that converts AC voltage into DC voltage;

a regulator that receives the DC voltage from the AC-DC converter and outputs a constant DC voltage; and a light emitting device driver that outputs the constant DC voltage from the regulator as one or more driving pulses.

5. The illumination apparatus according to claim 1, wherein the adapter includes:

a connection terminal configured to be connected to a fluorescent lamp socket; and a power terminal groove or socket configured to be connected to a power terminal of the light emitting device illumination part.

6. The illumination apparatus according to claim 1, wherein the light emitting device illumination part includes:

a substrate;

a plurality of light emitting device drivers on the substrate; and a power terminal at each of opposite ends of the substrate and configured to be coupled to the adapter.

7. The illumination apparatus according to claim 6, wherein the light emitting device includes a light-emitting diode (LED) or an organic light-emitting diode (OLED).

8. The illumination apparatus according to claim 7, wherein the light-emitting diode (LED) or the organic light-emitting diode (OLED) emits white light.

9. The illumination apparatus according to claim 6, wherein the substrate comprises a printed circuit board that provides power to the light emitting devices.

10. The illumination apparatus according to claim 6, wherein the substrate comprises a wiring on a plastic instrument.

11. The illumination apparatus according to claim 6, wherein the substrate further comprises a reflective coating layer.

12. The illumination apparatus according to claim 11, wherein the reflective coating layer comprises silver and/or aluminum.

13. The illumination apparatus according to claim 1, further comprising a cover that protects the light emitting device illumination part.

14. The illumination apparatus according to claim 13, wherein the cover comprises a transparent or translucent plastic material.

15. The illumination apparatus according to claim 14, wherein the transparent or translucent plastic material comprises a colored plastic.

16. The illumination apparatus according to claim 1, wherein the light emitting device illumination part comprises a plurality of modules.

17. A method of driving an illumination apparatus, comprising:

converting alternating power into driving power in an adapter;

emitting light from a light emitting device illumination part according to the driving power, the light emitting device illumination part being detachably and electrically connected to the adapter; and controlling an illumination direction of the light emitting device illumination part using a driving unit that is connected to the adapter and configured to rotatably drive the light emitting device illumination part.

18. The method according to claim 17, wherein the light emitting device illumination part comprises a plurality of sections, and the illumination direction of each section is controlled by the driving unit.

19. The method according to claim 17, wherein the light emitting device illumination part includes a plurality of light-emitting diode (LED) or organic light-emitting diode (OLED) light emitting devices.

20. The method according to claim 19, wherein the light-emitting diodes or the organic light-emitting diodes emit red, blue, and green light.

* * * * *